United States Patent [19]

Cho

[11] 3,960,346

[45] June 1, 1976

[54] KITE

[76] Inventor: Jin Sul Cho, G-3040 W. Bristol Road, Flint, Mich. 48507

[22] Filed: Jan. 27, 1975

[21] Appl. No.: 544,046

[52] U.S. Cl. ..... 244/155 A; 244/153 R

[51] Int. Cl.[2] ..... B64C 31/06

[58] Field of Search ..... 244/153 R, 155 R, 155 A, 244/154, 153 A, 43, 93

[56] References Cited

UNITED STATES PATENTS

| | | | |
|---|---|---|---|
| 1,009,274 | 11/1911 | Ayling | 244/153 R |
| 1,103,817 | 7/1914 | Niehoff | 244/153 R |
| 1,853,233 | 4/1932 | Schwarz | 244/93 |
| 2,518,768 | 8/1950 | Fugate | 244/153 R |
| 2,565,365 | 8/1951 | Gould et al. | 244/153 R |
| 3,055,622 | 9/1962 | Harmon | 244/153 R |
| 3,161,386 | 12/1964 | Umanoff | 244/153 R |

*Primary Examiner*—Trygve M. Blix
*Assistant Examiner*—Galen L. Barefoot
*Attorney, Agent, or Firm*—Basile and Weintraub

[57] ABSTRACT

A kite including a lightweight sheet material and a support structure. The sheet material is secured to the support structure. The support structure has at least one end thereof provided with a threaded profile. A threaded fastener is rotatably positionable on the support member to thereby balance the weight of the kite.

8 Claims, 3 Drawing Figures

KITE

BACKGROUND OF THE INVENTION

1. Field of the Invention

The present invention pertains to kites. More particularly, the present invention pertains to kites constructed of a light weight material which will fly without a tail. Even more particularly, the present invention pertains to kites having means associated therewith for balancing the weight of the kite.

2. Prior Art

The art of kites and kite flying has given rise to a plurality of developments relative thereto. For example, there has been developed kites with rudders; vane controlled kites; tailless kites; bridled kites and the like. With respect hereto, reference may be made to U.S. Pat. Nos. 1,744,529; 2,388,478; 2,519,594; 2,558,980; 2,696,960 and 3,335,984. Also, of interest hereto is U.S. Pat. No. 3,128,974 which teaches a kite which simulates a space capsule and having a weight disposed in the lower end thereof.

However, under most circumstances most kites still exhibit unstable aerodynamic performance including spinning and grounding. Heretofore, the prior art has not considered compensating for the weight differentials in the kite construction, per se. In other words, the prior art has not considered a direct balancing of the weight of the kite. Rather, the prior art has taught means and methods for overcoming weight differentials present in the kite. The present invention, on the other hand, provides a kite having means for balancing the weight thereof constructed therewith.

SUMMARY OF THE INVENTION

In accordance herewith there is provided a kite having means for balancing the weight thereof.

The kite hereof includes a lightweight sheet material having the corners thereof secured to support sticks in a conventional manner. Each of the support sticks has a threaded end which threadably carries thereon a means for weighting the kite.

The kite hereof is tailless and includes means for facilitating the stringing thereof.

For a more complete understanding of the present invention, reference is made to the following detailed description and accompanying drawing. In the drawing, like reference characters refer to like parts throughout the several views in which:

DESCRIPTION OF THE PREFERRED EMBODIMENT

Figure 1:
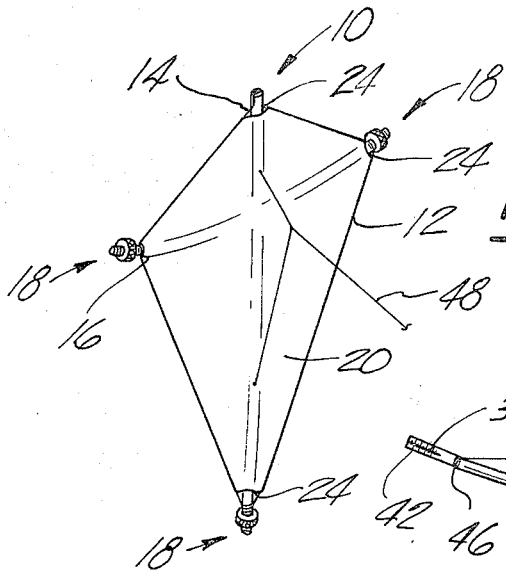
FIG. 1 is a perspective view of a kite in accordance with the present invention.
Figure 2:
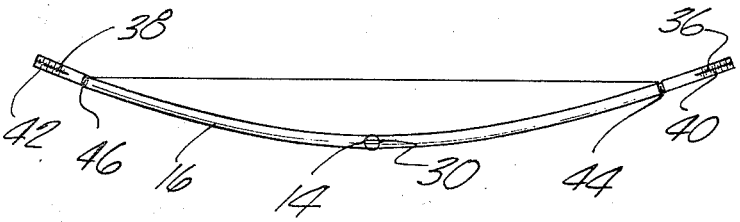
FIG. 2 is an end elevational view of the kite hereof.

Now with reference to the drawing, there is depicted therein a kite, generally indicated at 10, comprising a sheet material 12, support sticks or members 14, 16, respectively, and means for balancing the weight of the kite, generally indicated at 18.

With more particularity, the kite 10 hereof comprises a sheet material 12 which is of light weight. The material 12 may be of any suitable manufacture such as paper, sheet polyethylene and the like. Conventionally, the material 12 has a quadrangular configuration having a longitudinal length greater than the latitudinal length. The material 12 hereof is depicted as being double layered, having layers 20, 22 and wherein the layer 20 terminates at the apeces thereof short of the terminus of layer 22 to define openings 24 through which the ends of the support members are inserted. In this manner the support members are enveloped by the sheet material 12. It is to be understood, however, that the construction of the sheet material as a single layer connected or otherwise secured to the termini of the support members is equally applicable herein.

Referring again to the drawing, and as previously noted, the present kite, also, includes support members 14, 16. The support members extend substantially perpendicular to each other. In order to maintain the perpendicular relationship therebetween, at the point of intersection of the members, they are provided with mating notches 26, 28, respectively. In this manner, the support members are interengageable.

For purposes of facilitating an understanding of what is set forth hereinafter, the support member 14 will be referred to as the longitudinally-directed member and the support member 16 will be referred to as the latitudinally-directed member.

Figure 3:
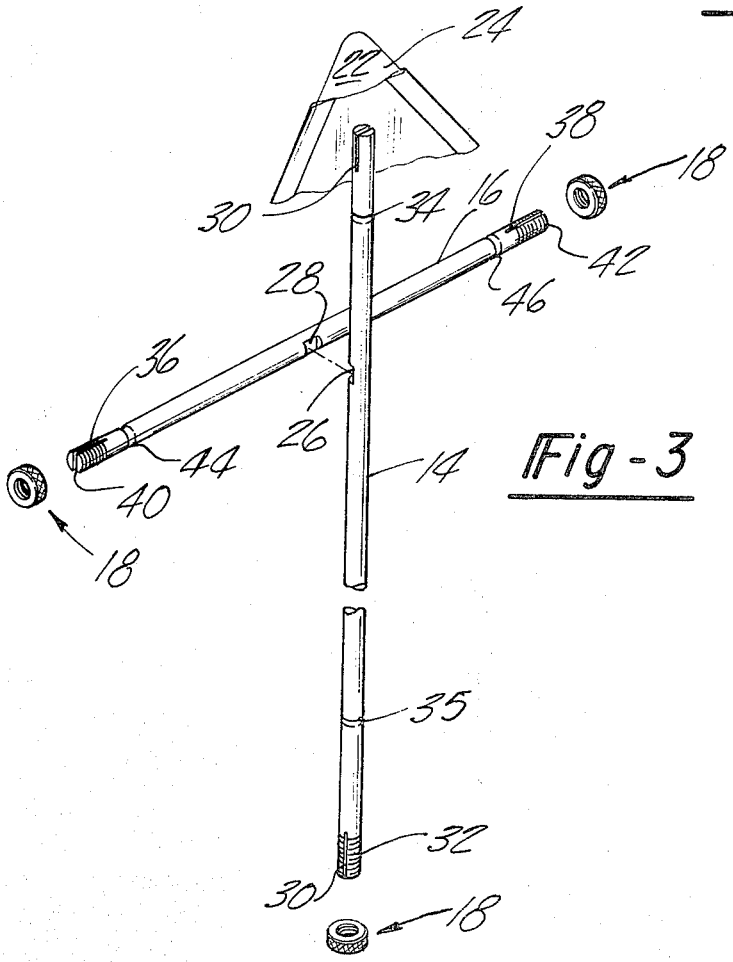
FIG. 3 is an exploded, perspective view, partially broken, of the kite of the present invention.

The longitudinal member 14 has each end thereof provided with a slot 30. The slots 30 define a string retaining slot when the kite is strung. As clearly shown in FIG. 3, the lowermost end of the longitudinal member 14 is provided with a threaded profile or thread 32. The thread 32 threadably receives thereon means 18 for balancing the weight of the kite. The means 18 can comprise any suitable internally threaded member, such as a screw, bolt, nut or the like. By providing the threaded connection between the means 18 and the support member 14, the means 18 is positionally adjustable thereon. It should further be noted that the means 18 provided on the end of the longitudinal member 14, also functions as the tail of the kite.

Disposed along the axis of the member 14 are annular grooves 34, 36, one each on each side of the notch 26. The grooves 34, 36 define string retaining means when the kite is strung.

The latitudinally-directed member 16 is constructed analogously to member 14. However, each end of the member 16 has a threaded profile or thread 36, 38, each of which receives a means 18. Each end of the member 16 is slotted in the manner heretofore described, with slotes 40, 42, respectively.

Each end of the member 16 is provided with an annular string retaining groove 44, 46, respectively.

In practicing the present invention, the apeces of the quadrangular sheet material are mounted on the ends of the support members. A string 48 is then strung around the periphery of the sheet material, through the slots 30, 40 and 42 and then around the annular grooves 34, 36, 44 and 46.

In fabricating the support members 14, 16 and the means 18, any suitable material, such as a synthetic resin or the like can be used. In deploying the kite 10, if the kite, when lofted, is spinning then by rotating the means 18 either inwardly or outwardly, this effect can be obviated.

It is apparent from the preceding that there is provided hereby a kite of simple construction which effectively compensates for weight distribution problems as well as for aerodynamic conditions.

Having then described the invention, what is claimed is:

1. A kite, comprising:

a. a lightweight sheet material, b. a support member having the sheet material secured thereto, wherein the support member has a string retaining slot formed at at least one end thereof and c. means for balancing the weight of the kite comprising a threaded member threadably rotatable positionable on the support member.

2. The kite of claim 1 which further comprises:

a. a first support member extending in a first direction;

b. a second support member extending in a direction substantially perpendicular to the first support member and intersecting the first support member; and wherein each support member has at least one end thereof provided with a threaded profile for receiving the threaded members.

3. The kite of claim 2 wherein each support member has a notch at the point of intersection therebetween such that the support members inter-engage.

4. The kite of claim 2 wherein each end of each support member has a string retaining slot.

5. The kite of claim 2 wherein one support member has a threaded profile at each end thereof and the other support member has a threaded profile at only one end thereof.

6. The kite of claim 5 wherein the means for balancing comprises a threaded member rotatably positionable on the ends of the support members.

7. The kite of claim 6 wherein the means for balancing associated with the support member having the single threaded profile defines a tail for the kite.

8. The kite of claim 1 wherein the support member has a threaded profile at at least one end thereof, the means for balancing being threadably connected thereto.

* * * * *